US005595003A

United States Patent [19]

Snow

[11] Patent Number: 5,595,003

[45] Date of Patent: Jan. 21, 1997

[54] ATHLETIC SHOE WITH A FORCE RESPONSIVE SOLE

[76] Inventor: A. Ray Snow, 11810 S. Hidden Valley Rd., Sandy, Utah 84092

[21] Appl. No.: 199,166

[22] PCT Filed: Feb. 20, 1992

[86] PCT No.: PCT/US92/01354

§ 371 Date: Feb. 18, 1994

§ 102(e) Date: Feb. 18, 1994

[87] PCT Pub. No.: WO93/03639

PCT Pub. Date: Mar. 4, 1993

Related U.S. Application Data

[63] Continuation-in-part of Ser. No. 969,243, Feb. 19, 1993, abandoned, which is a continuation of Ser. No. 570,906, Aug. 21, 1990, abandoned.

[51] Int. Cl.[6] ..... A43B 13/18

[52] U.S. Cl. ..... 36/28; 36/27; 36/31; 36/35 R; 36/37

[58] Field of Search ..... 36/27, 28, 30 R, 36/31, 32 R, 35 R, 36 C, 37, 43, 44, 102

[56] References Cited

U.S. PATENT DOCUMENTS

| | | | |
|---|---|---|---|
| 904,891 | 11/1908 | Otlerstedt | 36/28 |
| 1,778,089 | 10/1930 | Pomerantz | 36/35 R |
| 1,993,208 | 3/1935 | Cohn | 36/17 |
| 3,834,046 | 9/1974 | Fowler | 36/28 |
| 4,187,620 | 2/1980 | Selner | 36/28 |
| 4,798,009 | 1/1989 | Colonel et al. | 36/28 |
| 4,843,735 | 7/1989 | Nakanishi . | |
| 4,888,887 | 12/1989 | Solow . | |
| 4,897,937 | 2/1990 | Misevich et al. . | |
| 4,956,927 | 9/1990 | Misevich et al. | 36/32 R |
| 4,999,931 | 3/1991 | Vermeulen | 36/29 |

FOREIGN PATENT DOCUMENTS

| | | | |
|---|---|---|---|
| 3507295 | 9/1986 | Germany | 36/28 |
| 666436 | 8/1964 | Italy | 36/28 |

*Primary Examiner*—Marie D. Patterson
*Attorney, Agent, or Firm*—Mallinckrodt & Mallinckrodt

[57] ABSTRACT

An athletic shoe with a force responsive sole includes a first sole portion (110) having a multiplicity of projecting cleats (20), a second sole portion (12) with corresponding apertures (22) to receive the cleats (20). In one embodiment, a resilient membrane (14) is positioned between the sole portions and normally covers the apertures (22) so as to hold the cleats (20) separated from the apertures (22) in a rest position. A correspondingly apertured guide plate (15) is provided between the first sole portion (10) and the membrane (14) in the apertures (26) of which the cleats (20) are positioned to restrict transverse relative movement of the two sole portions (10, 12) and to maintain the cleats (20) in alignment with the apertures (22). Under force applied by a foot in the shoe, the cleated first sole portion (10) moves toward the apertured second sole portion (12), stretching the membrane (14) as the cleats (20) move into the receiving apertures (22) of the second sole portion (12), with the membrane (14) resisting such movement to thereby provide cushioning and to provide rebound force. In other embodiments, a composite membrane (92, 94) made up of a number of individual membranes (92) in a carrier frame (94), or a series of resilient bands, such as O-rings (116), constitute the membrane to provide the resilience for the sole.

20 Claims, 7 Drawing Sheets

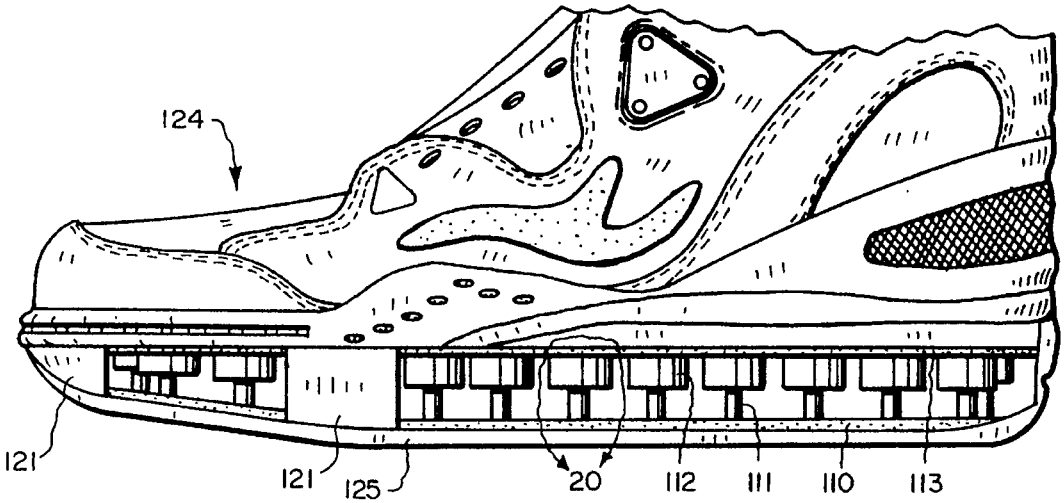
FIG. 19
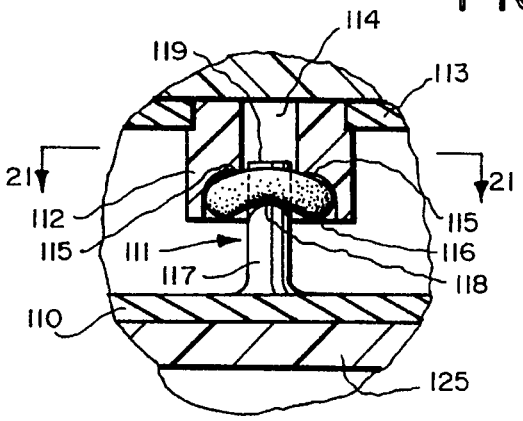
FIG. 20
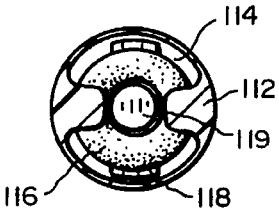
FIG. 21
FIG. 22
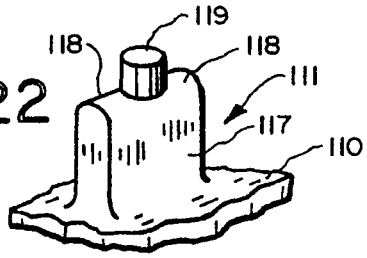
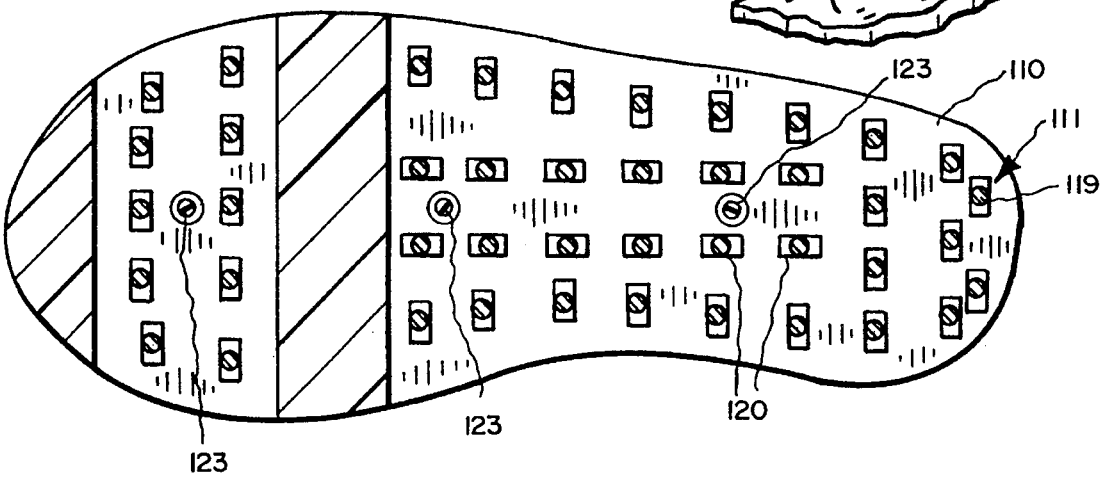
FIG. 23

ATHLETIC SHOE WITH A FORCE RESPONSIVE SOLE

RELATED APPLICATIONS

This is a continuation-in-part of my application Ser. No. 969,243 filed Feb. 19, 1993, entitled "Athletic Shoe With A Force Responsive Sole", now abandoned, which resulted from PCT/US91/05946 filed Aug. 20, 1991, which was a continuation-in-part of application Ser. No. 570,906, filed Aug. 21, 1990, also entitled "Athletic Shoe With A Force Responsive Sole", now abandoned.

BACKGROUND OF THE INVENTION

1. Field

This invention is in the field of athletic shoes which provide a cushioning effect on the feet during motions such as walking, jumping, and running.

2. State of the Art

Shoes with cushioned soles are well known in the art. The majority of these, however, rely on a cushioned sole made of a foam-type material. The problems associated with a sole comprising such a material are twofold. First, the sole loses its cushioning abilities and wears out after a relatively short time. This creates the added expense and inconvenience of replacing either the individual sole or the entire shoe at a more frequent rate than is desirable. Second, cushioned soles made of foam-type material do not always provide adequate support for the arch, ball, heel and other critical areas of the foot. Such lack of support can cause innumerable foot and leg injuries like shin splints, bone spurs, and muscle spasms and tears.

Other systems for cushioning the foot are becoming quite common. For example, at least one shoe manufacturer produces a shoe which has inflatable chambers actuated by a push-button pump. These chambers are inflated in anticipation of strenuous activity and deflated after completion thereof. Theoretically, the chambers are filled only to the level which will provide the proper amount of support for the intended activity and thus provide the advantage of variable support. Some problems, however, have been associated with this system as well. Inadvertent leakage of the pumped air has required an increase in the wall thickness of the chambers, resulting in a decreased level of responsiveness in the chambers' performance. Furthermore, the pumps are easily broken, which negates any advantage the system may have provided in the first place.

Another system calls for the provision of gel or compressed air to be placed in closed pockets in the sole of the shoe, which has disadvantages.

Other known systems have various features in common with the present invention, e.g. the systems of Fowler U.S. Pat. No. 3,834,046 of Sep. 10, 1974, and of LICO Sportschuhfabriken, German DE 3507295 A1 of Sep. 4, 1986, but lack the combination of features that have made the present invention operatively superior.

SUMMARY OF THE INVENTION

The present invention is an improved sole construction for an athletic shoe which not only provides cushioning for the foot of the wearer, but also provides a high degree of energy return or rebound to the wearer of the shoe.

The shoe includes a first sole portion having spaced cleats extending therefrom and a second sole portion having correspondingly spaced apertures for receiving the cleats.

Resilient means are held between the first and second sole portions at least partially covering the apertures and cooperable with the cleats for normally maintaining the first and second sole portions spaced apart with the cleats of the first sole portion aligned with the receiving apertures of the second sole portion. Cleat guide means restricts lateral relative movement of the first and second sole portions to maintain alignment of the cleats with the apertures and to stabilize the shoe during athletic activities. Means interconnect the first and second sole portions and a shoe upper for receiving a wearer's foot is secured to one of the sole portions while a ground-contacting receiving surface is secured to the other sole portion.

In one embodiment of the shoe, the shoe includes a top sole portion with downwardly extending cleats and a substantially coextensive bottom sole portion with apertures corresponding to the cleats so as to receive therein the cleats of the top sole portion. A resilient membrane is positioned and held between the top and bottom sole portions to normally maintain such top and bottom sole portions in a spaced apart, rest configuration wherein the cleats of the top sole portion are held by the membrane above and in alignment with the receiving apertures of the bottom sole portion. When force is applied to the sole of the shoe, such as by a person standing, walking, running, jumping, or landing in the shoe, the force is absorbed by the membrane as the cleats of the top sole portion move into the receiving recesses of the bottom sole portion, with the membrane stretching therebetween. When the force is removed, the membrane urges the top and bottom sole portions apart to their normal rest positions wherein the membrane is unstretched. With this construction, the membrane is force responsive and stretches in response to the force applied, to thereby effectively cushion and support the foot of the wearer. Further, the resilient membrane stores energy as it is stretched under force and returns that energy as the force is removed, thus providing a high degree of rebound to the shoe.

An important feature of this arrangement in accordance with the present invention is a guide plate having cleat-receiving openings and being interposed between the top sole portion and the resilient membrane being substantially coextensive therewith, and with the cleats positioned in the cleat receiving openings of the guide plate to insure effective operation by reason of maintaining the cleats substantially centered relative to the apertures of the bottom sole portion and by restricting lateral relative movement between the two sole portions. In one embodiment of the invention, the membrane is coextensive with the bottom sole portion and is secured to the bottom sole portion by gluing it thereto and is secured to the top sole portion by screws extending through the membrane into selected cleats. In this way, the top and bottom sole portions are interconnected through the membrane. The cleat-guide plate is preferably glued to the top of the membrane so that the membrane is sandwiched between such guide plate and the bottom sole portion. A shoe upper of any desired type, high or low, is attached to the top sole portion, while a ground-contacting wearing surface is provided at the bottom of the bottom sole portion.

A flexible side cover is provided about the perimeter of the sole portions to close the space therebetween and prevent foreign matter, such as rocks, from becoming lodged between the top and bottom sole portions to interfere with proper operation of the shoe. This side cover may be secured only around the perimeter of the top sole portion, hanging freely therefrom as an apron or skirt so that the bottom sole portion is free to move up and down in relation to the cover, or the cover may be flexible and attached around the perimeter of both the top sole portion and bottom sole portion so the side cover will flex and bend to allow relative movement of the top and bottom sole portions. Again, a perimetrical closure strip of flexible and preferably elastomeric material may be sealingly interposed between the apron or skirt and the sole to completely seal the sole against entry of foreign matter. In some embodiments, the perimetrical side cover secured to the top sole portion and the bottom sole portion serves as the means interconnecting the sole portions.

Although the top sole is usually the cleated one as described above, the arrangement of the parts can be reversed with operation remaining essentially the same.

The characteristics of the membrane may be varied over various parts of the sole so that different support and cushioning properties are provided over different parts of the sole and therefore, different parts of a wearer's foot. In alternate embodiments of the invention, rather than the membrane being coextensive with a sole portion, individual membranes may be provided associated with each of the apertures. This makes it easy to vary the characteristics of the membrane over different parts of the sole since a membrane of desired characteristics can be individually provided for each aperture. In such embodiment, the individual membranes may be held between the first and second sole portions by a carrier or holding means which also serves as the cleat guide means. In some embodiments, the membrane may take the form of O-rings or other elastic bands positioned in the apertrues to cooperate with the cleats. In one embodiment, O-rings are supported by aperture shoulder means and interact with shoulder means on the cleats.

THE DRAWINGS

In the accompanying drawings, which show the best mode presently contemplated for carrying out the invention:

FIG. 1 is a side perspective view of a preferred embodiment of the present invention, a portion of the side cover of the shoe being broken away to reveal otherwise hidden internal structure of the shoe sole;

FIG. 2, a bottom plan view of the shoe of FIG. 1 having the ground-contacting wearing surface of the shoe sole broken away to show the bottom sole portion and the apertures therein;

FIG. 3, a vertical section taken on the line 3—3 of FIG. 2, drawn to a larger scale and including the ground contacting wearing surface;

FIG. 4, an enlarged fragmentary vertical section of a typical cleat and receiving recess, the normal rest position shown in solid lines and the position of the cleat when subjected to force shown in broken lines;

FIG. 5, a fragmentary vertical section of the toe portion of the shoe of FIG. 1 in compressed condition;

FIG. 6, a longitudinal vertical section taken on the line 6—6 of FIG. 2, with the shoe in normal rest position;

FIG. 7, a view corresponding to that of FIG. 6 showing the shoe under maximum compressive force all along its length;

FIG. 8, a vertical section similar to the lower part of FIG. 6, showing a second embodiment of the cleats;

FIG. 9, a longitudinal horizontal section taken on the line 9—9 of FIG. 8;

FIG. 10, a bottom plan view similar to that of FIG. 2, but showing a third embodiment of the cleat-receiving apertures and cleats of the invention;

FIG. 11, a side elevation of a shoe which includes another embodiment of the invention shown in longitudinal vertical section at a broken-away portion of the shoe;

FIG. 12, a fragmentary transverse vertical section taken on the line 12—12 of FIG. 11;

FIG. 13, a fragmentary horizontal section taken on the line 13—13 of FIG. 11;

FIG. 14, a view similar to that of FIG. 11 showing another embodiment of the invention in longitudinal vertical section taken axially of the shoe sole;

FIG. 15, a vertical section taken through still another embodiment of the invention having a composite resilient membrane, the view being drawn to approximately the scale of FIG. 12;

FIG. 16, a horizontal section taken on the line 16—16 of FIG. 15;

FIG. 17, a fragmentary vertical section of an intermediate portion of FIG. 15 showing the cleat depressed under load and stretching the underlying portion of the composite membrane and showing a slightly different embodiment of the invention;

FIG. 18, a fragmentary view corresponding to the left-hand portion of FIG. 12, but showing yet another embodiment of the invention.

FIG. 19, a side elevation of a shoe with the side cover of the shoe removed to show still another embodiment of the invention;

FIG. 20, an enlarged view of the area within the line 20—20 of FIG. 19, but showing the cleat and receiving apertures in vertical section;

FIG. 21, a fragmentary horizontal section taken on the line 21—21 of FIG. 20;

FIG. 22, a perspective view of a cleat of the embodiment shown in FIGS. 19–23; and FIG. 23, a top plan view of the lower sole portion of the shoe shown in FIG. 19.

DETAILED DESCRIPTION OF THE ILLUSTRATED EMBODIMENT

Figure 1:
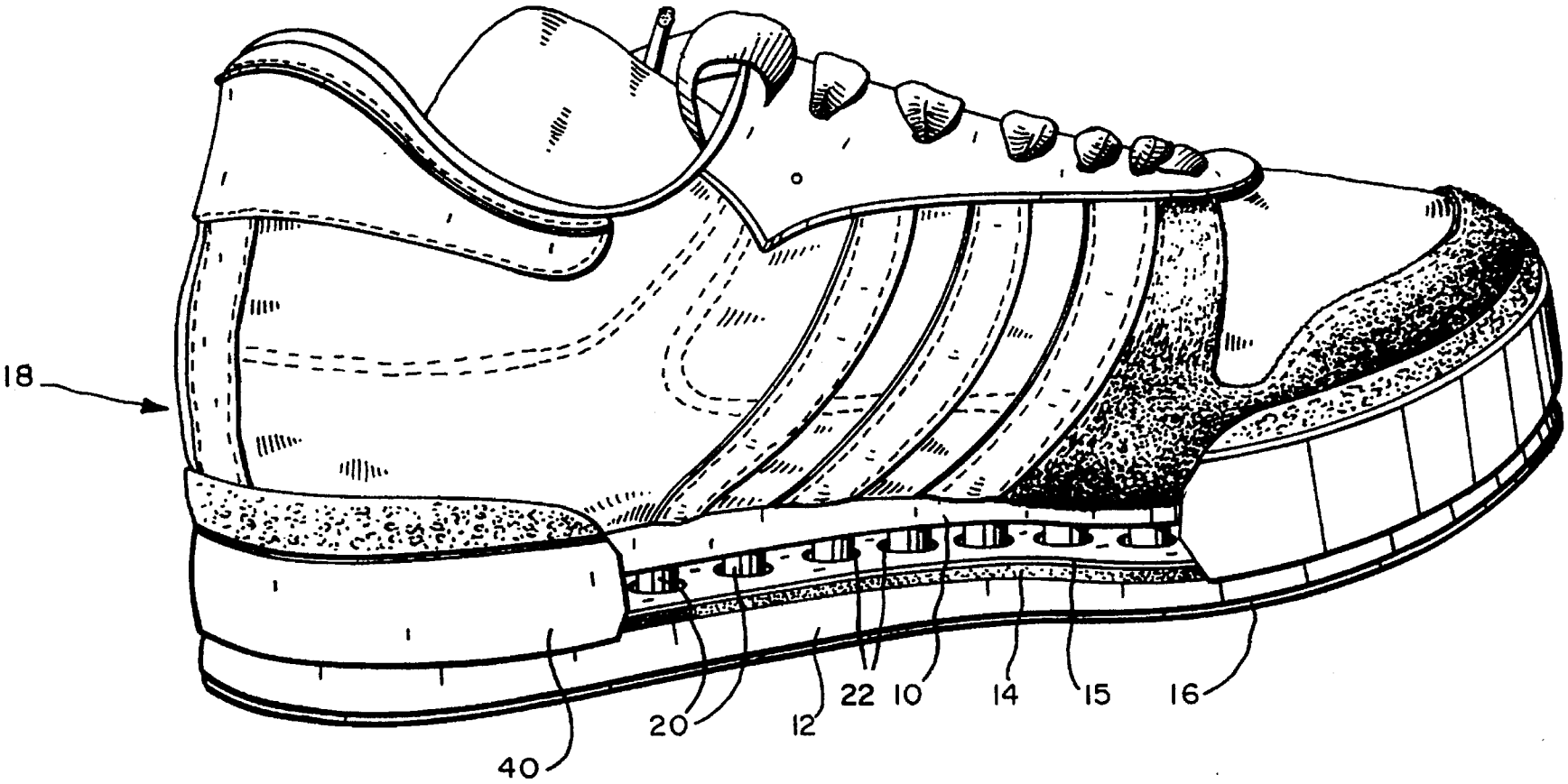
Figure 2:
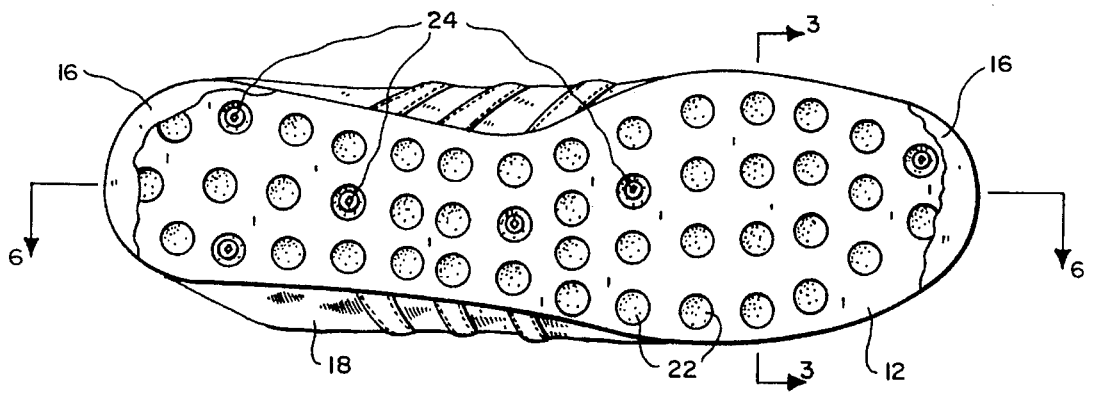

As illustrated in FIGS. 1–10, the athletic shoe of the invention comprises a top sole portion 10, a bottom sole portion 12, a resilient membrane 14 between top sole 10 and bottom sole 12, a cleat guide plate 15, a sheet of ground-contacting wearing surface material 16, and a standard shoe upper 18. The top sole portion 10 is preferably made of a hard rubber or plastic material and includes a plurality of downwardly-extending cleats 20. Bottom sole portion 12 is constructed of a polyurethane microcellular plastic or other suitable elastomer material and has the same parametric shape as top sole portion 10. Bottom sole portion 12 includes apertures 22 in numbers equal to the number of cleats 20 of the upper sole portion 10, each aperture 22 being sized, shaped, and located to correspond to and receive a cleat 20 of top sole portion 10 therein as covered by stretched portions of membrane 14. As shown in FIGS. 1–7 the cleats 20 are cylindrical and peg-like, while receiving apertures 22 in bottom sole portion 12 are cylindrical holes.

Resilient membrane 14, which may be gum rubber, surgical rubber, or other suitable resilient material, is preferably secured to the top of bottom sole portion 12, as by gluing, covering the cleat-receiving apertures. The cleats 20 rest on top of membrane 14 and in this embodiment in which the sole portions are not interconnected by the side closure of the shoe, membrane 14 is secured to selected cleats 20 by screws 24, FIGS. 2, 6, and 7, which extend through such membrane 14 into the selected cleats. For the embodiment shown in FIGS. 1–7, it has been found that a total of five such screws 24 are sufficient to effectively connect the top sole portion 10 to membrane 14. Since membrane 14 is attached to bottom sole portion 12 in this embodiment, top sole portion 10 is connected to bottom sole portion 12 through membrane 14.

Figure 3:
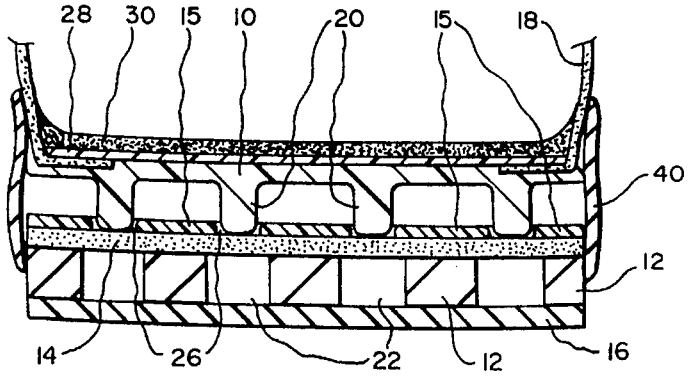
Figure 4:
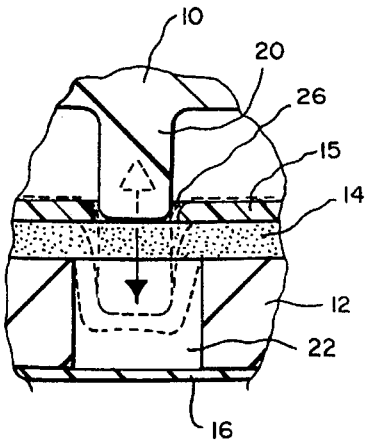
Figure 5:
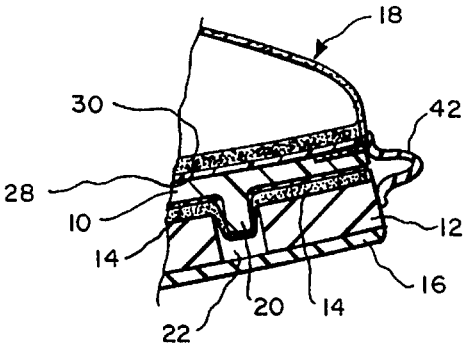
Figure 7:
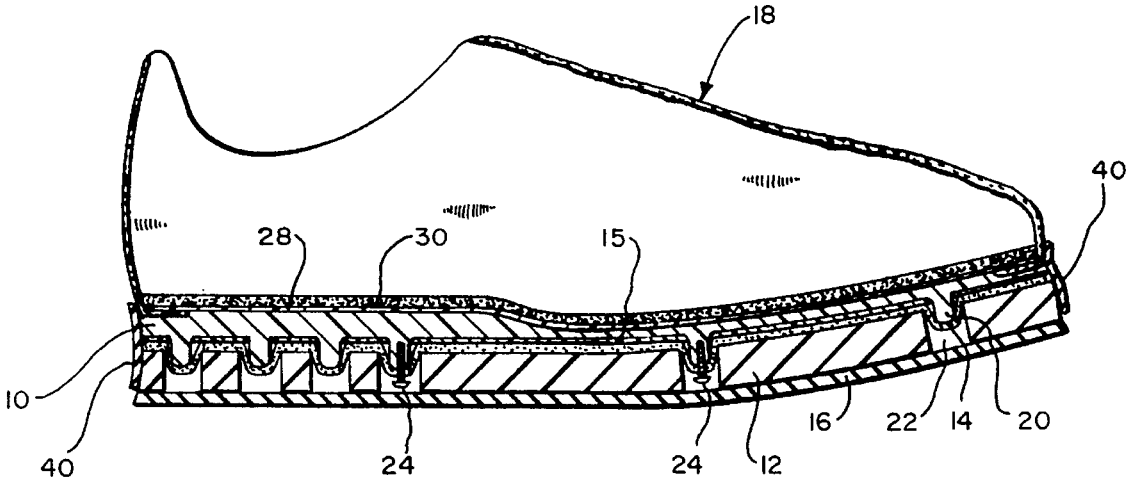

As a feature of the present invention, a guide plate 15 (which may be relatively thin and semi-rigid) is placed between the membrane and the cleated sole portion, preferably being secured to the membrane by gluing. Accordingly, as here shown, membrane 14 is sandwiched between bottom sole portion 12 and guide plate 15. Guide plate 15 has apertures or cleat-receiving openings 26, FIGS. 3 and 4, which are aligned with and correspond to apertures 22 in bottom sole portion 12, and in which the cleats 20 are positioned. Generally, the apertures 26 in guide plate 15 will be smaller than apertures 22 in bottom sole portion 12 so that cleats 20 fit relatively closely, as shown in FIGS. 3 and 4. Only the cleats 20 are received by guide plate apertures 26, while both the cleats 20 and the underlying portions of membrane 14 are received in sole bottom portion apertures 22, as shown in FIGS. 4, 5, and 7. Cleats 20 are positioned in guide plate apertures 26 at all times to restrict lateral relative movement between top sole portion 10 and bottom sole portion 12 and to insure that the cleats are properly aligned with the apertures.

Figure 6:
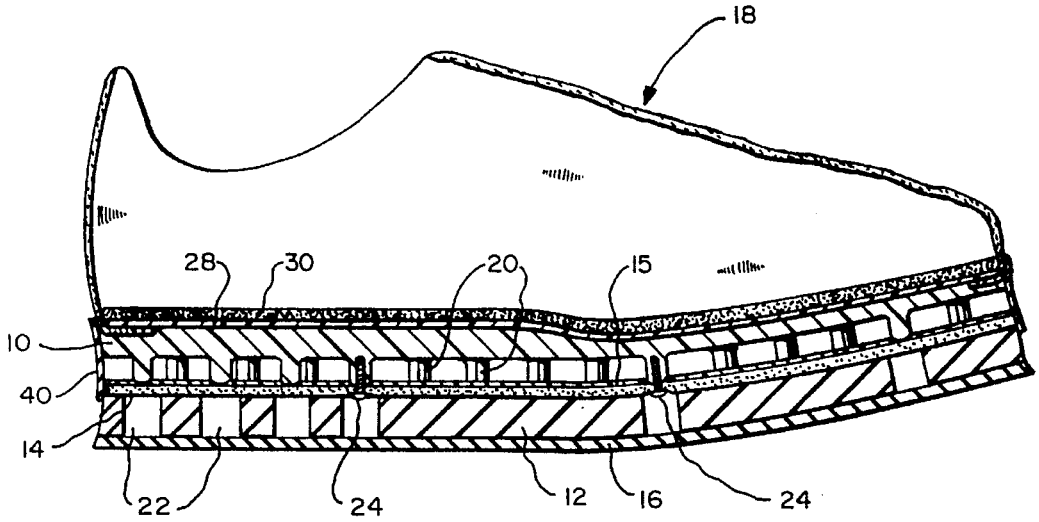

Any type of shoe upper 18 may be secured to top sole portion 10 in manner well known to the shoe manufacturing industry, and layers of padding 28 and 30, FIGS. 3, 6 and 7, may be provided (as is normal) to cushion the sole and conform it to the shape of the bottom of the wearer's foot. The shoe upper may be either low top or high top and may be made of a variety of materials such as leather, canvas, or a synthetic. Further, the shoe upper may be of lace type as shown in FIG. 1, may have Velcro or other fasteners, or may merely be of slip-on type.

When the shoe is in the condition in which no force is applied, such as when the shoe is off the foot of the wearer or when the wearer is sitting, this is its normal rest condition as shown in FIGS. 3 and 6 and in solid lines in FIG. 4. In this condition, the membrane is unstretched and extends across the top of the bottom sole portion and supports the cleats above the apertures of the bottom sole portion, as shown. When force is applied to the shoe, as when the wearer stands in the shoe, walks, runs, jumps, or performs other activities in the shoe, the force causes movement of the top sole portion toward the bottom sole portion. This causes the cleats to move into the apertures of the bottom sole portions and, in such movement, causes stretching of the membrane. The broken lines in FIG. 4 show a cleat 20 in aperture 22 with membrane 14 stretched. In stretching, the membrane resists movement of the cleats into the apertures, i.e., resists movement of the top sole portion toward the bottom sole portion. The extent of this substantially vertical relative movement depends upon the amount of force applied and the characteristics of the membrane. FIGS. 4, 5, and 7 show the maximum displacement of the cleats into the apertures.

Normally, the membrane will be chosen so that maximum displacement will not occur under expected forces to be applied to the shoe, and displacement will be less than the maximum and dependent upon the force applied. Thus, when a wearer jumps and lands, more force is applied than during normal standing or walking and more stretching or displacement of the membrane occurs. Also, the displacement will not generally be uniform along the length and width of the shoe, uniform displacement being shown in FIG. 7 merely for purposes of illustration but will vary depending upon the activity. During walking or running, when weight is initially placed on the heel at the beginning of a step, the displacement will occur in the area of the heel, with little or no displacement in the area of the toe. As the walking or running step continues, and weight shifts to the toe, displacement moves from the heel area through the mid portion of the sole to the toe area. As the membrane returns from a stretched condition to its normal or to a less stretched condition, it returns force to the shoe and to the foot of the wearer. Thus, as a wearer jumps and puts increased force on the membrane, causing increased stretch, the membrane will "spring back" to return such force to the wearer and help the wearer rebound from such membrane-stretched positions.

The characteristics of the membrane and the size, number, and location of the cleats will be varied depending upon the intended size and weight of the user and the activities to be performed while wearing the shoe. Thus, different model shoes with different membrane characteristics may be made for different activities. Further, the specific characteristics of the membrane may be varied for different parts of the sole so, for example, the membrane over the heel part may be less stretchable than the member over the toe part and thus require more force to displace a cleat into the aperture a given distance for the heel part than for the toe part.

As indicated in FIGS. 4 and 7, it is preferred that the thickness of the bottom sole portion, and thus the depth of the apertures, be slightly greater than the length of the cleats so the cleats do not extend through the aperture to the ground surface. It is also preferred that the bottom of the bottom sole portion have a layer of ground-contacting material 16, such as the rubber material normally used on the bottom of athletic shoes. While the additional layer of ground-contacting material is preferred, in some instances the bottom sole portion itself could be made to serve as the ground-contacting material.

A side cover 40, FIGS. 3, 6, and 7, of apron or skirt formation is preferably provided extending about the perimeter of the top sole portion and bottom sole portion to cover the space between the two to prevent foreign objects, such as pebbles, dirt, etc., from entering the space and interfering with the relative movement of the two. Also, it adds to the aesthetics of the shoe. This apron or skirt 40 is in the form of a strip of rubber or plastic material secured, as by gluing, around the perimeter of the top sole portion and extending freely downwardly to the upper perimeter of the bottom sole portion to cover the space between the top and bottom sole portions when in the normal rest portion, as shown in FIGS. 3 and 6. In this embodiment, apron or skirt 40 is not secured to bottom sole portion 12, so such bottom sole portion 12 is free to slide up and down in relation to apron or skirt 40 as indicated in FIG. 7 relative to FIG. 6, but, with such an apron or skirt, it is preferable to utilize the embodiment of FIG. 18 as described hereinafter.

Alternately, the side cover can take the form of a strip 42, FIG. 5, which is secured, as by gluing, to the perimeter of both the top sole portion and the bottom sole portion and is flexible enough to flex outwardly as shown in FIG. 5 as the top and bottom sole portions move toward one another. Here, since the side cover interconnects the top and bottom sole portions, in some embodiments, it is not necessary to use the screws 24.

Figure 9:
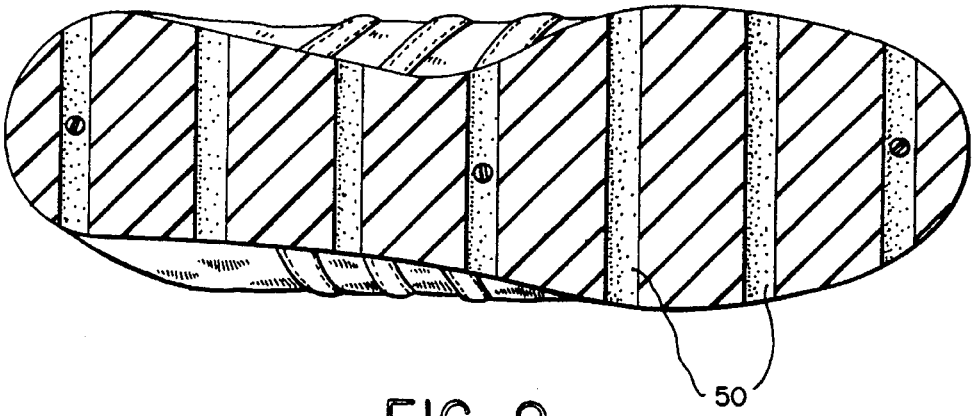
Figure 8:
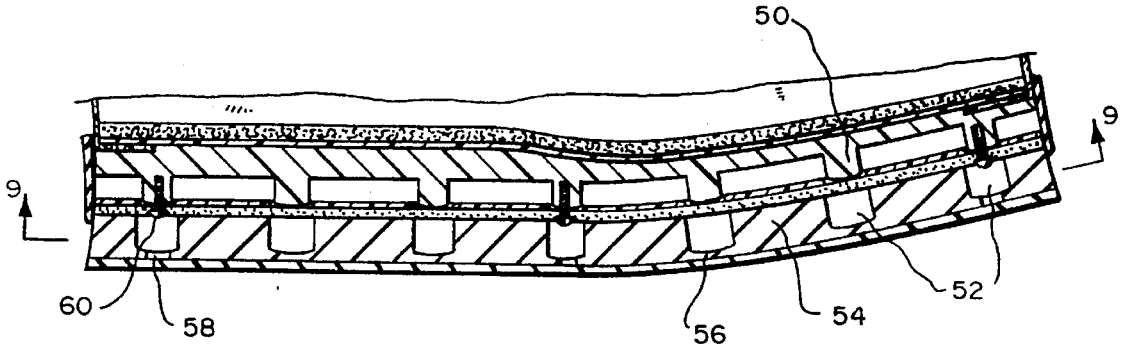

While the cleats 20 and receiving apertures 22 have been shown in FIGS. 1–7 as cylindrical, various shapes of cleats and receiving apertures may be used. For example, FIGS. 8 and 9 show a second embodiment of the invention wherein the cleats 50 and receiving apertures 52 are elongate rather than cylindrical in form, and extend from side-to-side of the shoe. As illustrated, FIG. 8, in this embodiment the receiving apertures 52 do not extend completely through the bottom sole portion 54, but leave a thin portion 56 at the bottom of each aperture so that the bottom sole portion remains in one piece for ease of assembly. Holes 58 allow access to screws 60 which correspond to the screws 24 in the previous embodiment.

Figure 10:
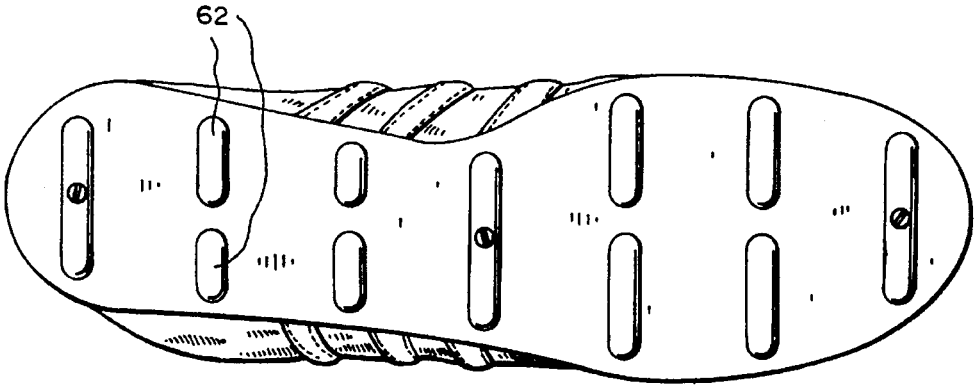

FIG. 10 shows a third alternate embodiment for the cleats, with elongate cleats 62 extending only partially across the cleated sole portion.

Although the invention has been described and shown with cleats of similar size over the entire area of the sole, the size of the cleats may vary. Thus, during normal activity more force is applied at the heel area of the sole than at the toe area, so the length of the heel area cleats may be longer to give a larger range of stretch and force adsorption than the cleats of the toe area which generally are subject to less force.

In a prototype of the invention, a membrane of natural gum rubber, one-eighth of an inch thick and of forty durometer hardness, has been found satisfactory for general use such as walking and running. However, wide variations in the characteristics of the membrane may be desirable, depending upon the intended use of the shoe and the intended wearer. Further, various means of connecting the top and bottom sole portions to the membrane can be used.

Figure 11:
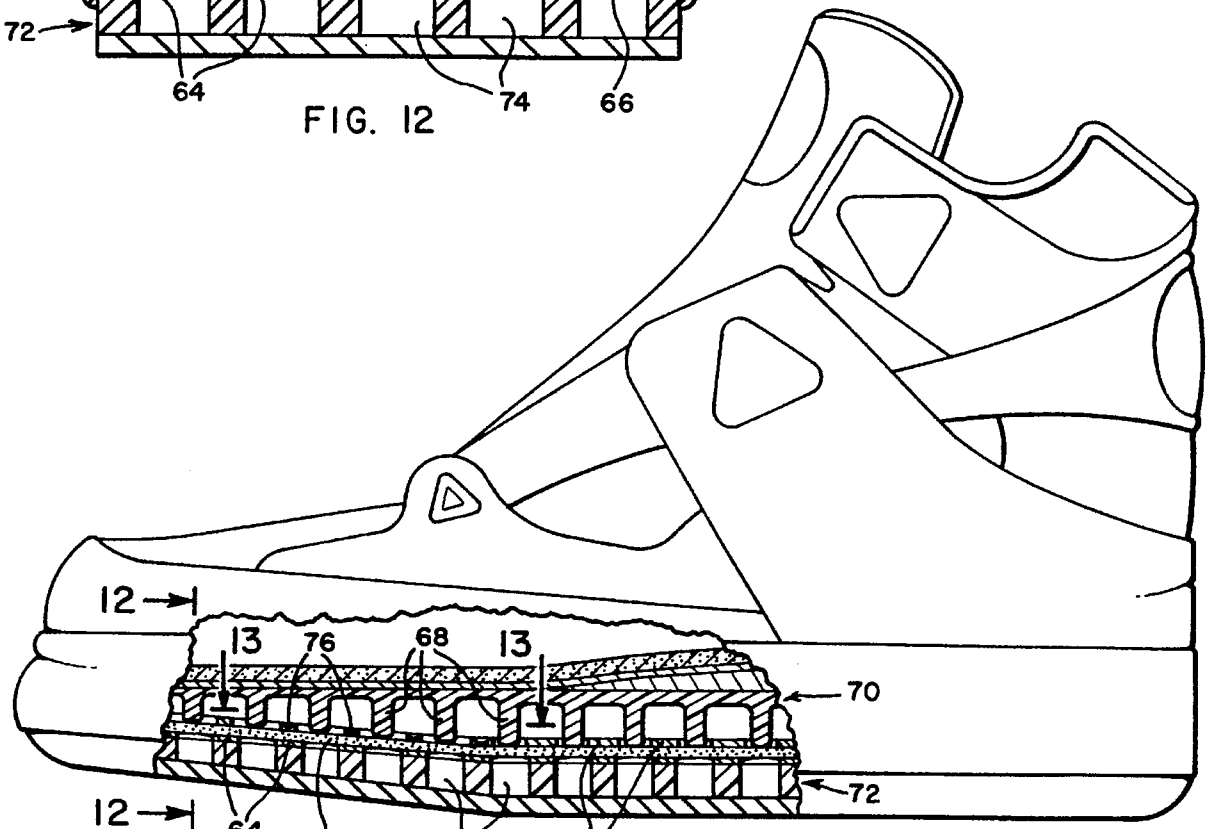
Figure 12:
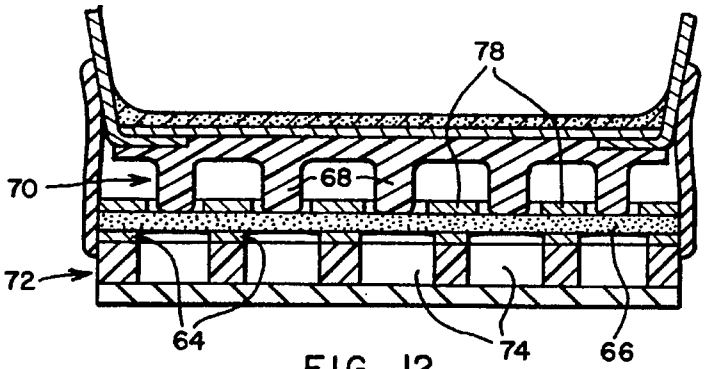
Figure 13:
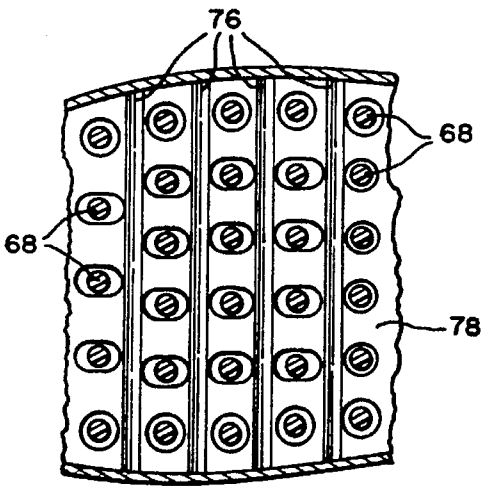

The embodiment of the invention shown in FIGS. 11–13 includes a support plate 64, which confronts the bottom of resilient membrane 66 and is apertured to receive the cleats 68 of top sole portion 70 covered, as they will be, by the stretched portions of membrane 66. Provision of support plate 64 protects the margins of bottom sole portion 72 surrounding the respective apertures 74 thereof, against spalling off or wearing away under pressure of the membrane. Also, support plate 64 will generally be of a harder or more rigid material than is bottom sole portion 72 so that the edges of support plate 64 around aperture 74 do not deform substantially. Therefore, particularly when membrane 66 is secured to plate 64 such as by gluing over the entire surface of plate 64, plate 64 will limit the portion of membrane 66 which stretches in response to movement of cleats 68 to only that portion of the membrane extending over an aperture 74. This provides better control of the characteristics of the shoe. Although provision of support plate 64 is preferred in all embodiments, this embodiment includes transverse grooves 76 extending from side-to-side of guide plate 78, FIG. 13, between rows of the apertures therein as shown. Such apertures include marginal ones of circular configuration and interior ones of elongated formation, FIG. 13, in a forward area below the ball of the foot which, with the transverse grooves 76, tend to provide maximum freedom of movement for that area and for the toes of the foot of the wearer by increasing flexibility at those locations. Support plate 64 will preferably also have grooves corresponding to grooves 76 to increase its flexibility in that portion of the shoe.

Figure 14:
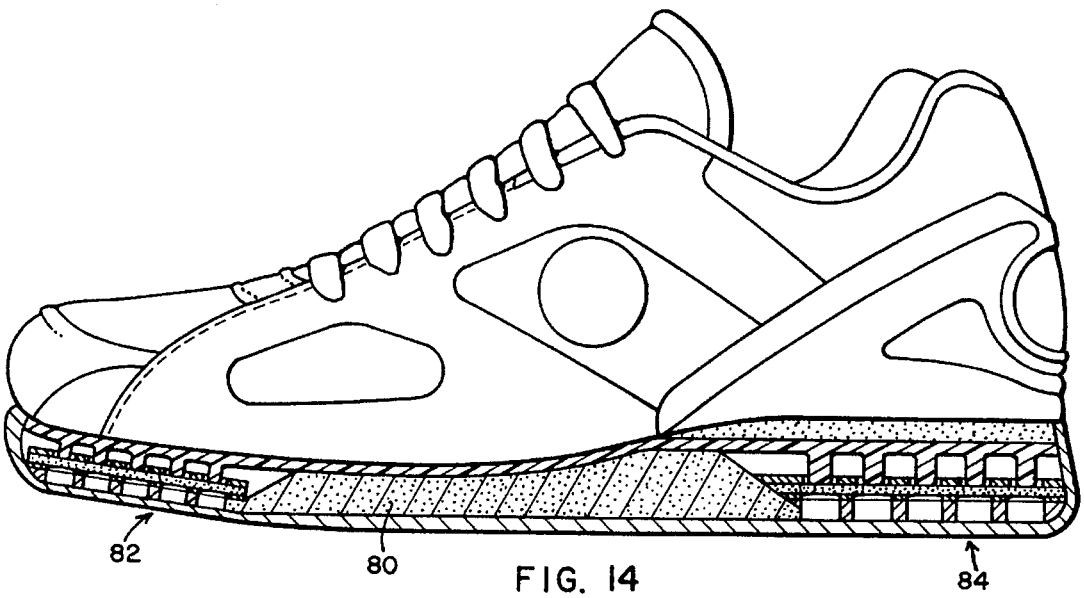

In some instances, it may be desireable to provide the sole construction of the invention for only parts of the entire shoe sole, for example, for only the heel part, for only the toe part, for only the intermediate part, or for various combinations. For example, it may be desireable to provide a more traditional sole construction for the intermediate longitudinal part of the sole and the construction of the invention for the heel and toe parts where most pressure is applied during sports activities. In the embodiment of FIG. 14, the intermediate longitudinal portion 80 of the sole of the shoe is solid, being provided by a microcellar polyurethane elastomer or similar material. The toe portion 82, which extends to and preferably under part of the ball of the foot, is similar to what is shown in FIG. 12. At the rear of the shoe, commencing approximately at the ankle, the heel portion 84 of the sole of the shoe is made similarly to what is shown in FIGS. 11 and 12.

Figure 16:
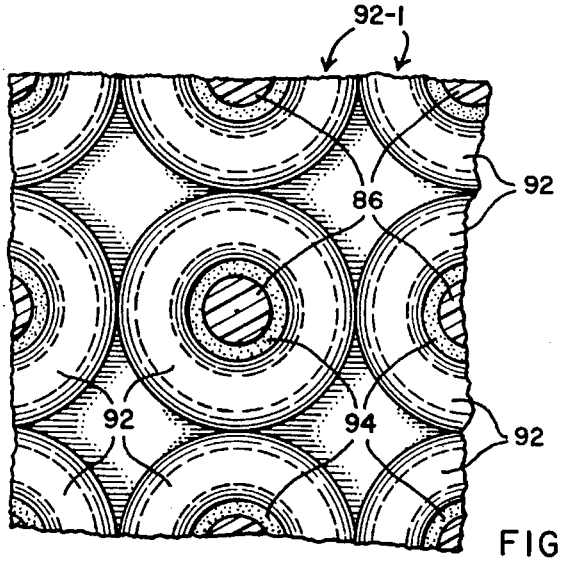
Figure 15:
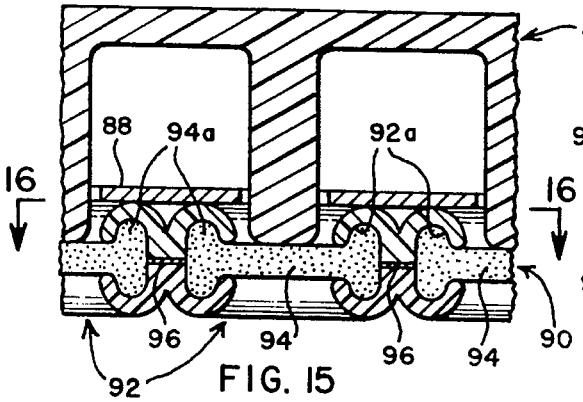
Figure 17:
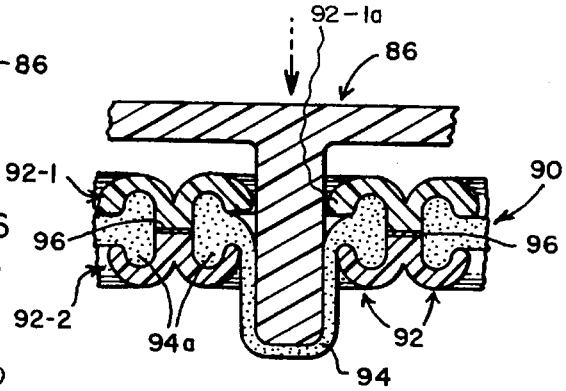

The embodiment of FIGS. 15–17 utilizes a cleated top sole portion 86 overlying a composite resilient membrane 90 made up of multiple circular units 92 which each contain an individual resilient membrane 94. Thus, the individual membranes 94 may vary in durometer, thickness, or other characteristic to provide desired stretchability at particular locations along the length and width of the shoe sole.

The units 92, which form a carrier frame for the individual membranes 94, are preferably injection molded integrally in horizontal half-sections 92-1 and 92-2, respectively, from a suitable material, which half-sections are secured together, as by glue 96, after introduction into receiving pockets **92*a* thereof of enlarged rims 94*a* of the individual membranes 94. The material used for units 92 must be rigid enough to hold the individual membranes 94 therein, so a substantially rigid material will generally be necessary. In such instance, provisions, such as grooves similar to grooves 76 of FIG. 13** or other weakening of the carrier frame in areas where increased flexibility is desired, are made to provide the desired flexibility to the shoe soles. Alternatively, the carrier could be provided in several separate pieces in order to provide the desired flexibility of the sole.

A separate cleat guide plate 88, FIG. 15, may be provided on top of the composite membrane 90, or, as shown in FIG. 17, the carrier frame itself may form the cleat guide plate. As shown, carrier frame 92 includes portions **92-1*a* which extend vertically above membranes 94 and thereby can act in the same manner as a guide plate for holding the cleats against lateral movement. However, as shown in FIG. 17, which excludes separate guide plate 88, in instances where the carrier frame forms the guide plate, portions 92-1*a* for the top half 92-1 of the carrier will generally extend farther inwardly over the membrane than the corresponding portions of the bottom half 92-2 to provide the desired restriction on lateral movement of the cleats and thereby form an integral cleat guide plate. Thus, where the frame forms an integral cleat guide plate, frame top half 92-1 will be different from frame bottom half 92-2**.

Figure 18:
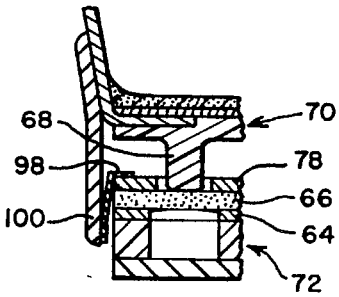

The embodiment of FIG. 18 includes a circular closure strip 98, glued along upper and lower edge margins to the cleat guide plate 78 and to the lower margin of the inside face of cover apron or skirt 100, respectively, so as to positively exclude entry of foreign matter into the operative areas of the shoe sole.

The embodiment of FIGS. 19–23 utilize O-rings or elastic bands as the resilient means or membrane. As shown in FIGS. 19–23, bottom sole portion 110 has a plurality of cleats 111 extending therefrom which are received in apertures 114 formed by cleat guide members 112 extending from top sole portion 113. Cleat guide members 112 may be separate pieces secured to top sole portion 113, such as by adhesive, or may be formed integrally with top sole portion 113.

Cleat guide members 112 are formed with a pair of shoulders 115, FIG. 20, extending from opposite sides into aperture 114. Shoulders 115 are located so that a resilient O-ring 116, or other resilient band, is supported near the end of the cleat guide member 112. Cleat 111 has an elongate portion 117 which forms a shoulder 118 with a central cylindrical extension 119 extending therefrom. Cleat 111 extends into aperture 114 between shoulders 115 and can move up and down therein.

With an O-ring 116 or other resilient band positioned in aperture 114 against shoulders 115, shoulder 118 of cleat 111 will engage O-ring 116 on either side of cylindrical extension 119. Cylindrical extension 119 will extend through the open center of O-ring 116. With O-ring 116 supported on opposite sides by shoulders 115 of the cleat guide member 112, FIG. 20, and with shoulder 118 of cleat 111 contacting opposite sides of O-ring 116 between shoulders 115, O-ring 116 forms a resilient membrane to urge the top sole portion and bottom sole portion apart as in prior embodiments. When pressure is applied to the shoe, cleat 111 will move in aperture 114 to stretch O-ring 116. While cleat 111 is shown with shoulder 118, cleat 111 could have other configurations, such as a cross configuration, to provide additional shoulders to engage the O-ring. In such instances, recess 114 and the shoulders extending thereinto to support the O-ring therein are appropriately modified to slidingly receive the modified cleat.

Cleats 111 are spaced over the lower sole portion 110 as indicated by FIG. 23 and preferably several of the cleats have an orientation rotated 90° from the other cleats. This is shown by cleats 120 in the central area of the lower sole portion. Cleat guide members 112 are similarly spread over the upper sole portion so that each cleat is received in a cleat guide member. While the cleats and associated cleat guide members may provide the total support for the shoe, it may be desireable, especially if the upper and lower sole portions are made of relatively stiff material, that traditional cushioning material 121 be provided in areas where increased flexibility is desired, such as near the ball of the foot where bending of a shoe normally takes place. However, even when the material 121 is provided for flexibility, primary support for the sale is provided by the resilient O-rings acting on cleats 111.

The upper and lower sole portions 113 and 110, respectively, may be held together with screws and for such purpose screw housings 123 are provided projecting from the lower sole so that a screw (not shown) can extend therefrom into the upper sole portion. The screw and screwhead can freely move down and up in the screw housings 123 during relative movement of the top and bottom sole portions toward and away from one another. A shoe upper 124 is secured to the top sole portion and ground-contacting material 125 is secured to the bottom sole portion.

Whereas this invention is here illustrated and described with specific reference to embodiments thereof presently contemplated as the best mode of carrying out such invention in actual practice, it is to be understood that various changes may be made in adapting the invention to different embodiments without departing from the broader inventive concepts disclosed herein and comprehended by the claims that follow.

I claim:

1. An athletic shoe having a force responsive sole, comprising a first sole portion having spaced cleats extending therefrom; a second sole portion having correspondingly spaced apertures for receiving said cleats and having margins about the circumference of each of said apertures; force responsive, resilient means held between said first and second sole portions at least partially covering said apertures and cooperable with said cleats for normally maintaining said first and second sole portions spaced apart, with the cleats of the first sole portion aligned with the receiving apertures of the second sole portion; cleat guide means in which the cleats of the first sole portion are positioned so that said guide means restricts lateral relative movement of said first and second sole portions; a correspondingly apertured support plate covering the second sole portion to protect the margins of said second sole portion surrounding the apertures thereof against damage by movement of the resilient means thereagainst when being stretched; means interconnecting said first sole portion and said second sole portion; a shoe upper for receiving a wearer's foot; and ground-contacting wearing surface for said sole.

2. An athletic shoe with a force responsive sole according to claim 1, wherein the resilient means is a resilient membrane means covering said apertures.

3. An athletic shoe with a force responsive sole according to claim 2, wherein the cleat guide means is a cleat guide plate substantially coextensive with the sole portions and the membrane means and having apertures corresponding to that of the second sole portion.

4. An athletic shoe with force responsive sole according to claim 3, wherein the support plate is adhesively attached to the second sole portion, and the membrane means is adhesively attached to said support plate.

5. An athletic shoe with a force responsive sole according to claim 4, wherein the cleat guide plate is secured to the resilient membrane means by an adhesive.

6. An athletic shoe having a force responsive sole, comprising a first sole portion having at least one cleat extending therefrom, said cleat having a length and including at least one cleat shoulder intermediate the length of the cleat; a second sole portion having at least one aperture corresponding to and for receiving said at least one cleat, said aperture having a depth and including at least one aperture shoulder positioned intermediate the depth of the aperture for relative side-by-side movement with respect to said at least one cleat shoulder; force responsive, resilient means, between said first and second sole portions at least partially covering the at least one aperture shoulder and cooperable with said at least one cleat shoulder for normally maintaining said first and second sole portions spaced apart, with the at least one cleat of the first sole portion aligned with the corresponding at least one receiving aperture of the second sole portion; means interconnecting said first sole portion and said second sole portion; a shoe upper for receiving a wearer's foot; and ground-contacting wearing surface for said sole.

7. An athletic shoe with a force responsive sole according to claim 6, wherein the resilient means is a ring of resilient material positioned between the cleat shoulder and the aperture shoulder.

8. An athletic shoe with a force responsive sole according to claim 6, wherein the at least one aperture is formed in a cleat guide member extending from the second sole portion.

9. An athletic shoe with a force responsive sole according to claim 6, wherein the shoe has a heel portion, and wherein the at least one cleat and at least one aperture are in only the heel portion of the shoe.

10. An athletic shoe having a force responsive sole, comprising a first sole portion having spaced cleats extending therefrom; a second sole portion having correspondingly spaced apertures for receiving said cleats; a plurality of force responsive, resilient means, each of the force responsive, resilient means being held between said first and second sole portions at least partially covering an aperture and cooperable with said cleats for normally maintaining said first and second sole portions spaced apart, with the cleats of the first sole portion aligned with the receiving apertures of the second sole portion whereby the cleats of the first sole portion extend into the apertures of the second sole portion to stretch the resilient means when a force is applied between the first and second sole means; means interconnecting said first sole portion and said second sole portion; a shoe upper for receiving a wearer's foot; and ground-contacting wearing surface for said sole.

11. An athletic shoe with a force responsive sole according to claim 10, including cleat guide means in which the cleats of the first sole portion are positioned so that said guide means restricts lateral relative movement of said first and second sole portion.

12. An athletic shoe with a force responsive sole according to claim 11, where the plurality of force responsive resilient means are mounted in respective frame portions of a carrier frame.

13. An athletic shoe with a force responsive sole according to claim 12, wherein a side of the carrier frame toward the first sole portion includes receiving apertures for the cleats of the first sole portion and forms the cleat guide means.

14. An athletic shoe with a force responsive sole according to claim 10, including a cover around the perimeter of the sole, said cover comprising an apron or skirt and a flexible, perimetrical sealing strip sealingly interposed between said apron or skirt and the sole.

15. An athletic shoe with a force responsive sole according to claim 10, wherein the sole comprises a longitudinal, intermediate, solid portion of elastomer material and cleated toe and heel portions.

16. An athletic shoe with a force responsive sole according to claim 10, wherein the plurality of force responsive, resilient means is a plurality of individual bands of resilient material, each band associated with an aperture and its corresponding cleat.

17. An athletic shoe with a force responsive sole according to claim 16, wherein each aperture includes aperture shoulder means, wherein each cleat includes cleat shoulder means adapted to fit and move between the aperture shoulder means of an aperture, and wherein the resilient means is positioned between the aperture shoulder means and the cleat shoulder means.

18. An athletic shoe with a force responsive sole according to claim 17, wherein the bands are O-rings.

19. An athletic shoe having a force responsive sole, comprising a first sole portion having at least one cleat extending therefrom; a second sole portion having at least one aperture corresponding to and for receiving said at least one cleat, said aperture having a depth and including at least one aperture shoulder positioned intermediate the depth of the aperture; force responsive, resilient means, supported between said first and second sole portions by the at least one aperture shoulder and cooperable with said at least one cleat for normally maintaining said first and second sole portions spaced apart, with the at least one cleat of the first sole portion aligned with the corresponding at least one receiving aperture of the second sole portion; means interconnecting said first sole portion and said second sole portion; a shoe upper for receiving a wearer's foot; and ground-contacting wearing surface for said sole.

20. An athletic shoe with a force responsive sole according to claim 19, wherein the shoe has a heel portion, and wherein the at least one cleat and at least one aperture are in only the heel portion of the shoe.

* * * * *